US005547408A

United States Patent [19]

Skyman

[11] Patent Number: 5,547,408

[45] Date of Patent: Aug. 20, 1996

[54] COMPRESSION WASHER ASSEMBLY WITH LINE CUTTER FOR A BOAT PROPELLER SHAFT

[75] Inventor: Lars Skyman, Gothenburg, Sweden

[73] Assignee: AB Volvo Penta, Gothenburg, Sweden

[21] Appl. No.: 446,623

[22] PCT Filed: Nov. 26, 1993

[86] PCT No.: PCT/SE93/01025

§ 371 Date: May 26, 1995

§ 102(e) Date: May 26, 1995

[87] PCT Pub. No.: WO94/12387

PCT Pub. Date: Jun. 9, 1994

[30] Foreign Application Priority Data

Nov. 30, 1992 [SE] Sweden ..... 9203593

[51] Int. Cl.[6] ..... B63H 1/28

[52] U.S. Cl. ..... 440/73; 416/146 R

[58] Field of Search ..... 440/73, 89; 416/93 A, 416/146 A, 146 B

[56] References Cited

U.S. PATENT DOCUMENTS

| | | | |
|---|---|---|---|
| 4,180,368 | 12/1979 | Henrich et al. | 416/146 R |
| 4,211,515 | 7/1980 | Henrich et al. | 416/146 R |
| 4,236,872 | 12/1980 | Metcalf | 416/146 R |
| 4,578,040 | 3/1986 | Sumino et al. | 440/73 |
| 4,609,361 | 9/1986 | Sumino et al. | 440/73 |
| 4,911,663 | 3/1990 | Meier | 416/146 |
| 5,007,867 | 4/1991 | Kelley | 440/73 |

*Primary Examiner*—Jesus D. Sotelo
*Attorney, Agent, or Firm*—Young & Thompson

[57] ABSTRACT

Compression washer assembly with line cutter for mounting on a boat propeller shaft between a shoulder on the shaft and the end of a propeller hub. The compression washer assembly comprises a hub portion with a cross section conforming to the shaft. The hub portion is fixed in a central opening in a sheet metal cup, the edge of which serves as a line cutting edge, and consists of a number of punched sheet metal washer.

9 Claims, 2 Drawing Sheets

COMPRESSION WASHER ASSEMBLY WITH LINE CUTTER FOR A BOAT PROPELLER SHAFT

The present invention relates to a compression washer assembly, for mounting on a boat propeller shaft between an abutment surface on the shaft and an end surface on a propeller hub, comprising an inner hub portion with a cross section conforming to the shaft and a cup with a line cutting edge.

A compression washer assembly with a line cutter of the type described above is intended firstly to distribute the axial load between the abutment surface of the shaft and the end surface of the hub over a greater area to reduce the axial surface pressure on the end surface of the hub and secondly to cut lines, e.g. fishing lines or nets, caught by the rotating propeller and which might otherwise be wound up and become jammed tightly between the propeller hub and the adjacent wall of the propeller housing, for example in an outboard drive unit.

In a known compression washer assembly with line cutter, the hub portion is a turned and pull broached element which is pressed into and glued into an opening in a cup of pressed sheet metal.

The purpose of the present invention is to provide a compression washer assembly with a line cutter, which, without affecting its function, can be manufactured more simply and at a lower cost than those previously known.

This is achieved according to the invention by means of the fact that the hub portion comprises a number of axially stacked continuous washers, which are fixed in an opening at the bottom of the cup.

Such a hub portion can be built up of a suitable number of washers, which can be thin enough to be punched from sheet metal. For example, a 4.5 mm long hub portion can consist of three washers punched from 1.5 mm thick sheet metal. The invention eliminates the need for machining the hub portion. The use of the same starting material, i.e. sheet metal, for the cup and the hub portion makes it possible to manufacture the cup and the hub portion at the same location, and with similar equipment.

Figure 1:
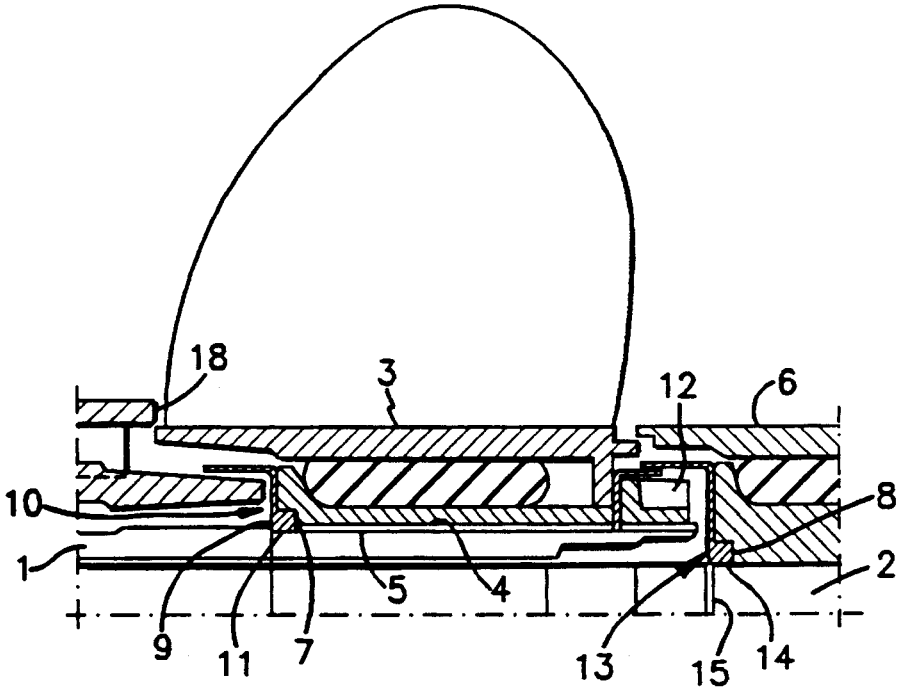
Figure 2:
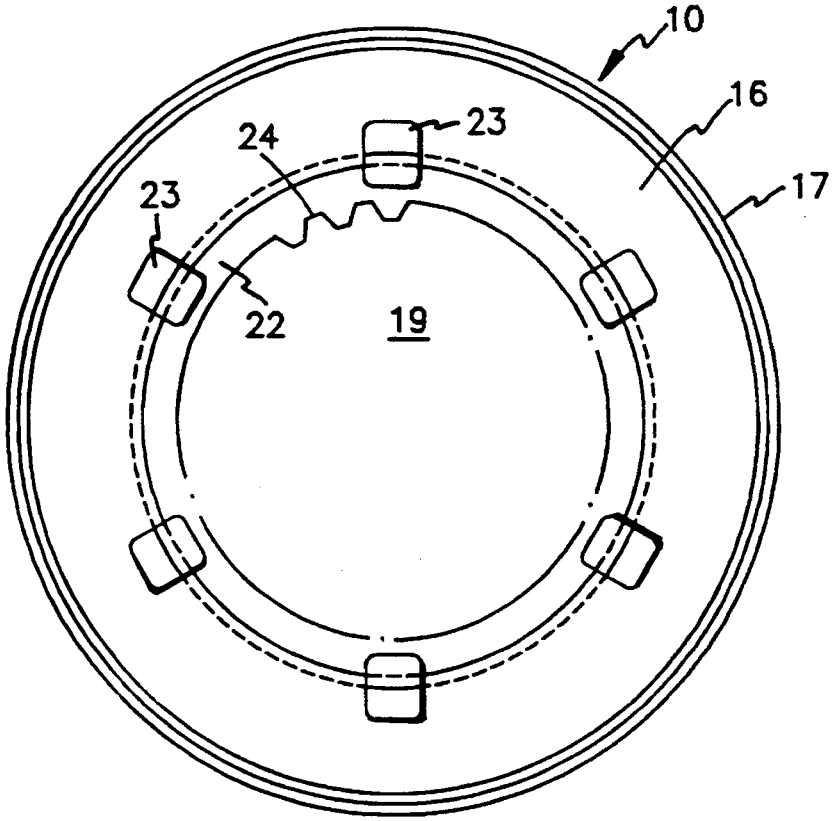
Figure 5:
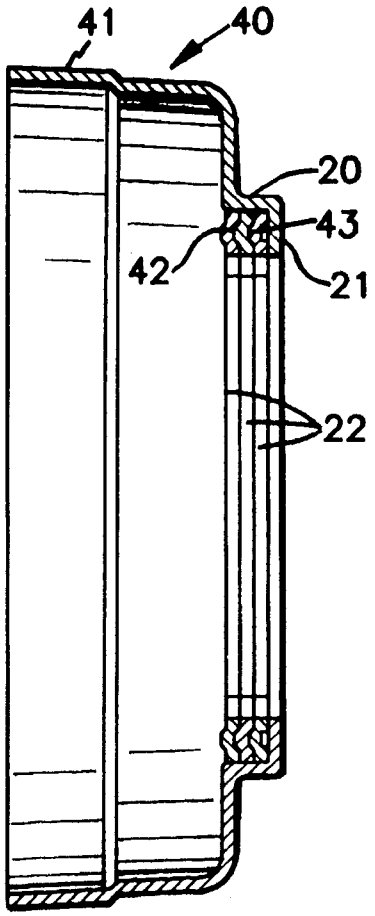
Figure 4:
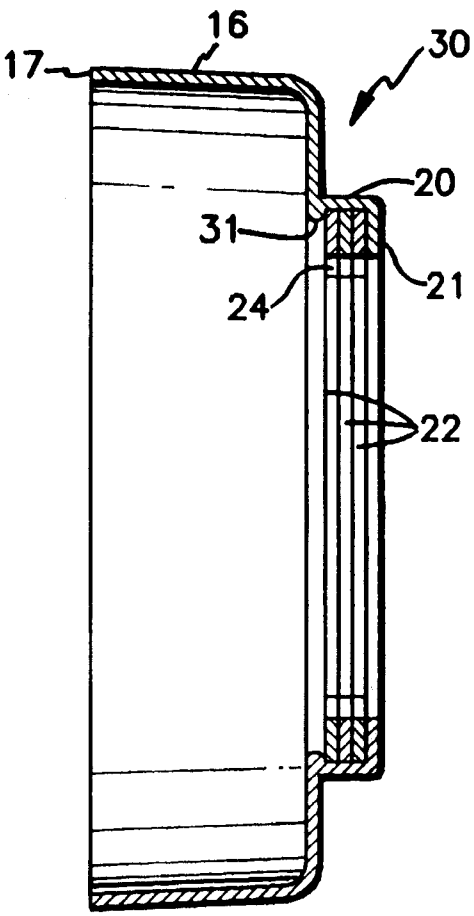
Figure 3:
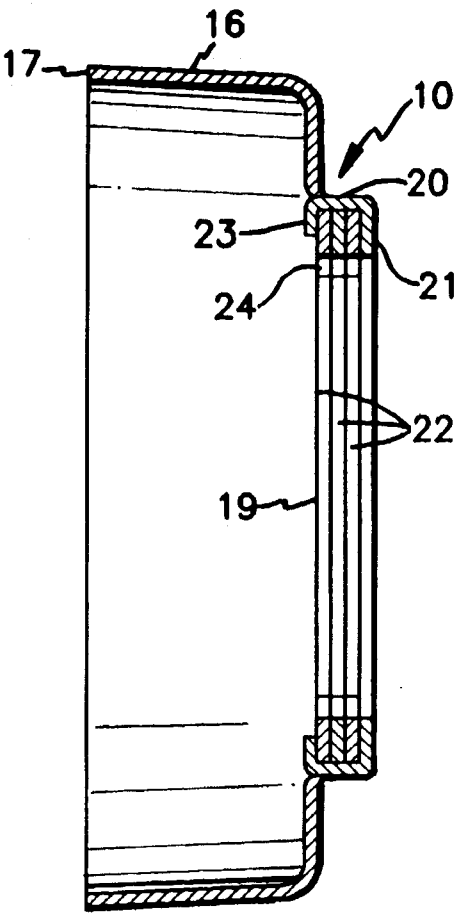

The invention will be described in more detail with reference to examples shown in the accompanying drawings, where FIG. 1 shows a longitudinal section through portions of a pair of propeller hubs carried by counter-rotating propeller shafts, with forward and aft compression washer assemblies with line cutters, FIG. 2 is a plan view of a first embodiment of a compression washer assembly with line cutter, FIG. 3 is a longitudinal section through the compression washer assembly in FIG. 2, FIG. 4 is a longitudinal section corresponding to FIG. 3 through a second embodiment, and FIG. 5 is a longitudinal section corresponding to FIGS. 3 and 4 through a third embodiment.

In FIG. 1, the reference numeral 1 designates a first propeller shaft in the form of a hollow shaft and 2 designates a second propeller shaft belonging to an outboard type propeller drive unit, for example an Aquamatic® drive unit, which is not shown in more detail here. The shaft 1 supports a propeller hub 3 which is fixed rotationally by means of external splines 4 on the shaft and internal splines 5 on the hub 3. The shaft 2 supports a hub 6 which is fixed rotationally by means of corresponding splines which are not shown in more detail here.

The hubs 3 and 6 have circular grooves 7 and 8, respectively, in their forwardly facing end surfaces. The hub portion 9 of a compression washer assembly with a line cutter, generally designated 10, lies in the groove 7. One end surface of the hub portion 9 is held pressed against a shoulder 11 on the shaft 1 by the hub 3, which presses with the bottom of the groove 7 against the opposing end surfaces of the hub portion 9 under the influence of a propeller lock nut 12. A corresponding compression washer assembly with line cutter, generally designated 13, has a hub portion 14 which is housed in the groove 8 and presses against a shoulder 15 of the propeller shaft 2.

The compression washer assembly 10 is shown in more detail in FIGS. 2 and 3. It comprises, in addition to the hub portion 9, a cup 16 of pressed sheet metal, the edge 17 of which forms a rotating cutting edge intended to cut lines, which due to the rotation of the propeller have been pulled in between the propeller hub 3 and the drive unit housing 18. The bottom of the cup 16 has a central opening 19 which is surrounded by a cylindrical portion 20, one end of which turns into a radial flange 21. The cylindrical portion 20 surrounds three annular washers 22 which are fixed as a unit between the radial flange 21 and six evenly spaced radially inwardly bent tabs 23, punched from the bottom of the cup 16. To allow the washers 22 forming the hub portion 9 to pass over the splines 4 of the shaft 1, the inner circumferences of the washers are correspondingly splined 24.

In a practical embodiment, the washers are punched from 1.5 mm thick sheet steel, while the cup 16 is pressed and punched from 0.8 mm sheet steel. The manufacturing process is thus quite simple. The washers 22 are given their final shape in a single punching step. This is to be compared with known compression washer assemblies, the hub portions of which, made in one piece, are first turned externally and internally and are then pull broached internally to make the splines.

FIG. 4 shows an embodiment of a compression washer assembly 30 with line cutter, differing from that shown in FIGS. 2 and 3 only in that the tabs 23 have been replaced by an inwardly directed bead 31. FIG. 5 shows an additional embodiment of a compression washer assembly 40 with line cutter, which has a cup 41 with a somewhat modified shape. The washers 22 are pressed into and possibly also glued into the cylindrical portion 20 of the cup. There is no counterpart to the tabs 23 or the bead 31. The washers have been stamped in this case to have complimentary raised portions 42 and depressions 43 which inter-engage to align the splines of the washers with each other.

The compression washer assembly 13 with line cutter in front of the rear propeller hub 6 has a hub portion 14, which, as the hub portion 9 described above, is composed of three punched sheet metal washers, lacking splines, however, since the shape of the shaft 2 is such that they are not required.

I claim:

1. Compression washer assembly, for mounting on a boat propeller shaft between an abutment surface on the shaft and an end surface on the propeller hub, comprising an inner hub portion with a cross section conforming to the shaft and a cup with a line cutting edge, characterized in that the hub portion (9) comprises a plurality of axially stacked continuous washers (22), which are fixed in an opening (19) at the bottom of the cup (16).

2. Compression washer assembly according to claim 1, characterized in that the washers (22) are fixed between upset portions (21,23;31) of the bottom of the cup (16).

3. Compression washer assembly according to claim 1, characterized in that the washers (22) are identically punched sheets metals washers.

4. Compression washer assembly according to claims 1, characterized in that the washers (22) have a thickness of about 1–1.5 mm.

5. Compression washer assembly according to claim 1, characterized in that the hub portion (9) consists of three washers (22).

6. Compression washer assembly according to claim 1, characterized in that the bottom of the cup (16) is made with a cylindrical portion (20) conforming to the outer diameter of the washers (22) and surrounding the washers, and having at opposite ends upset portions (21,23;31) between which the washers are securely held.

7. Compression washer assembly according to claim 6, characterized in that the washers (22) are securely held between a radial flange (21) at one end of the cylindrical portion (20) and a radial bead (31) at the opposite end.

8. Compression washer assembly according to claim 6, characterized in that the washers (22) are securely held between a radial flange (21) at one end of the cylindrical portion (20) and inwardly bent tabs (23) stamped out of the cup at the opposite end.

9. Compression washer assembly according to claim 1, characterized in that the washers (22) have on one side raised portions (42) which fit into depressions (43) on the opposite side of the washer.

* * * * *